United States Patent [19]

Church

[11] Patent Number: 4,764,770

[45] Date of Patent: Aug. 16, 1988

[54] STABILIZED MOLDED RUBBER KEYBOARDS

[75] Inventor: Roy L. Church, Santa Rosa, Calif.

[73] Assignee: Hewlett-Packard Company, Palo Alto, Calif.

[21] Appl. No.: 873,236

[22] Filed: Jun. 11, 1986

[51] Int. Cl.[4] ..... H01H 3/14

[52] U.S. Cl. ..... 340/365 R; 200/159 B; 200/5 A

[58] Field of Search ..... 340/365 VL, 365 R, 711, 340/712; 200/159 B, 159 A, 293, 295, 308, 340, 302.2, 302.1, 5 A, 5 R; 235/145 R; 400/473, 472, 490, 491

[56] References Cited

U.S. PATENT DOCUMENTS

| | | | |
|---|---|---|---|
| 3,120,583 | 2/1974 | Cornell | 200/5 A |
| 4,066,860 | 1/1978 | Kawasaki | 200/159 B |
| 4,119,839 | 10/1978 | Beckmann et al. | 340/365 VL |
| 4,355,483 | 10/1982 | Korzelius | 200/159 B |

FOREIGN PATENT DOCUMENTS

| | | | |
|---|---|---|---|
| 2077506 | 12/1981 | United Kingdom | 200/159 B |
| 2135827 | 9/1984 | United Kingdom | 200/159 B |

*Primary Examiner*—John W. Caldwell, Sr.
*Assistant Examiner*—Alvin Oberley
*Attorney, Agent, or Firm*—William C. Milks, III

[57] ABSTRACT

A keyboard assembly has a PC board providing a series of switch contacts and a molded rubber keyboard providing a rubber base sheet overlying the PC board and having a series of rubber keys integral with the base sheet. Each key has contacts on its bottom surface for closing each of the switch contacts when its key is depressed. Stabilizing membranes prevent the keys from wobbling or binding. The membrane snugly engages each key, and the membrane is flexible along its Z axis but sufficiently stiff along its X and Y axes to limit the movement of the keys to strictly linear movement toward and away from their respective PC board switches.

18 Claims, 7 Drawing Sheets

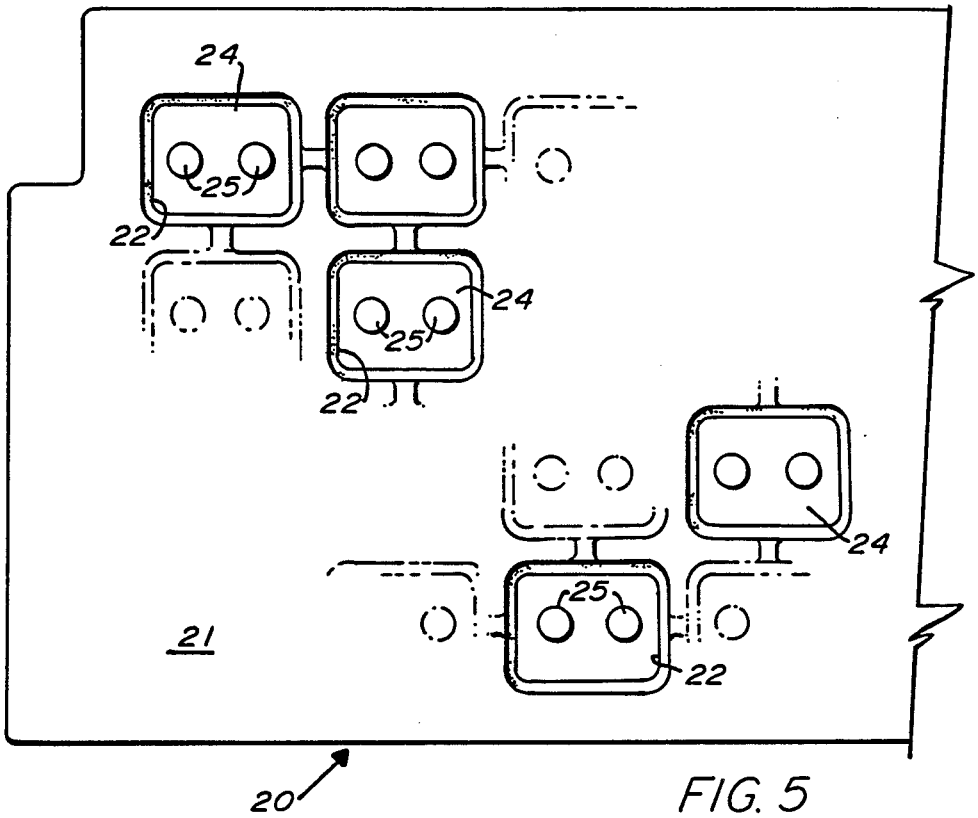
FIG. 5
FIG. 6
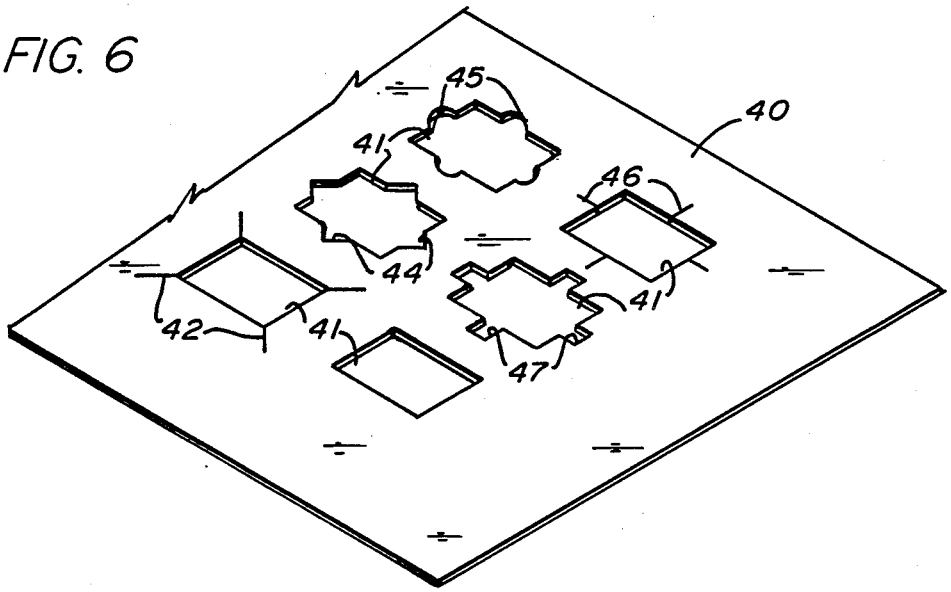

FIG. 7
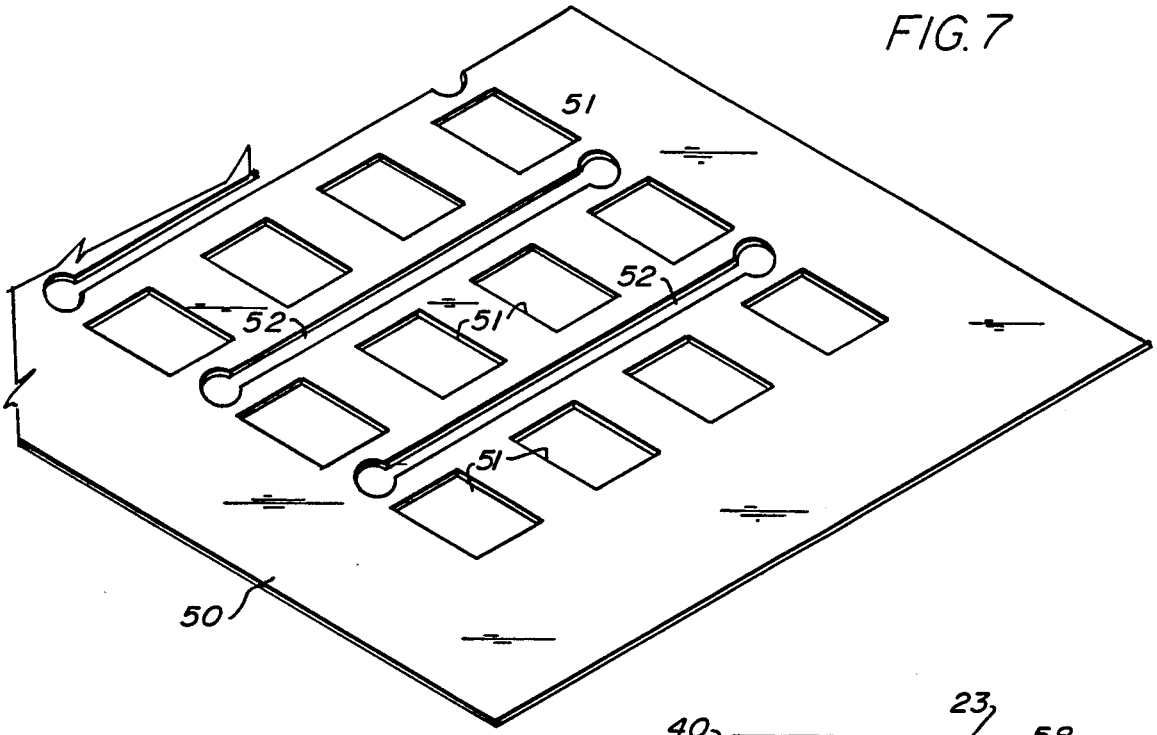
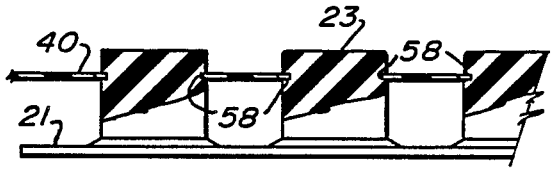
FIG. 9
FIG. 8
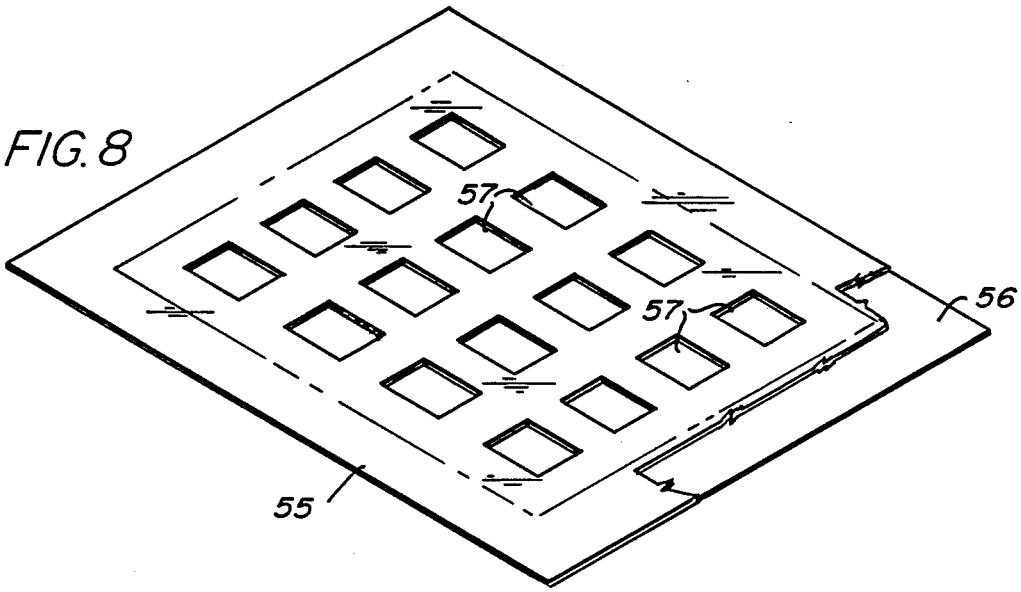

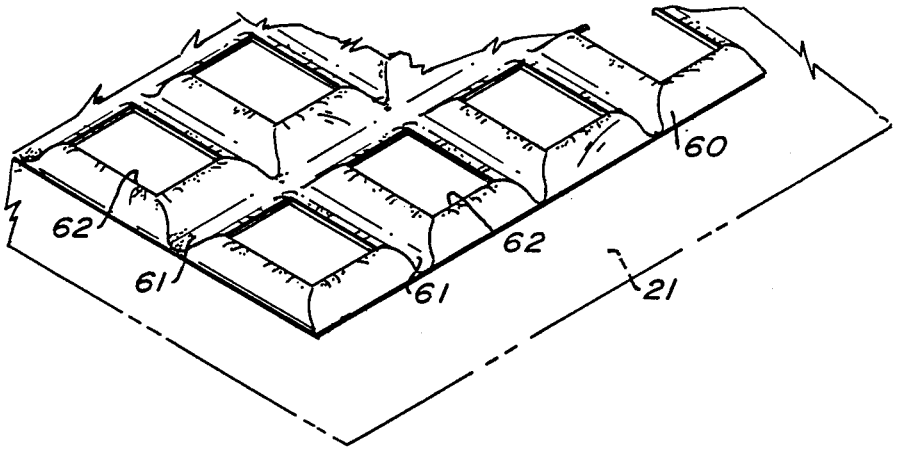
FIG. 10
FIG. 11
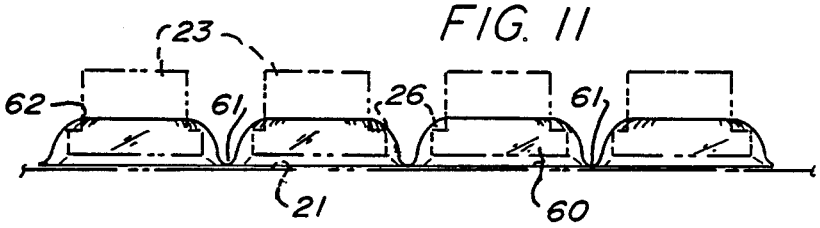
FIG. 12
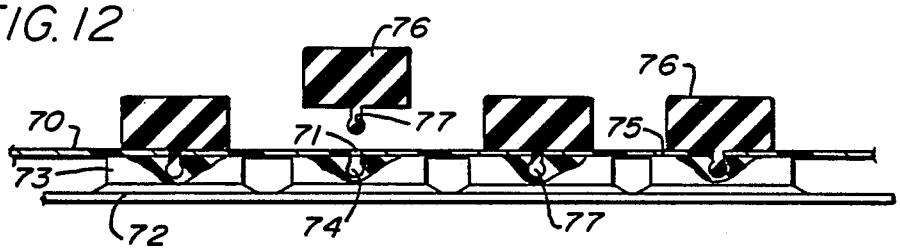
FIG. 13
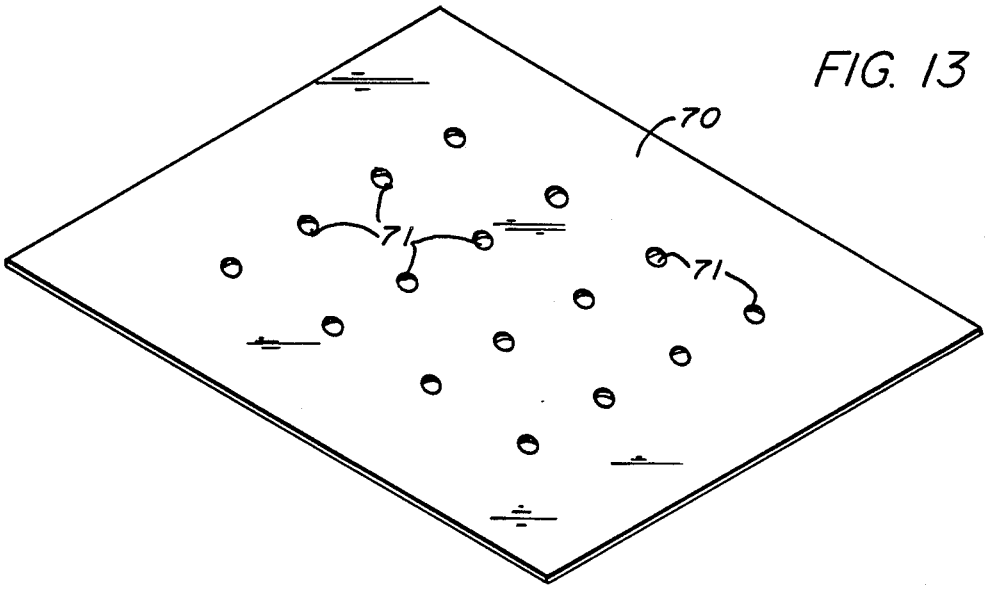

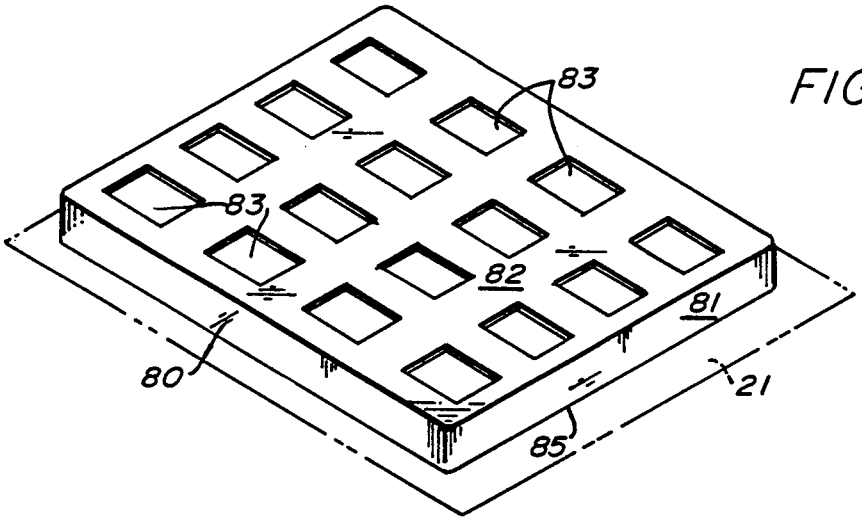
FIG. 14
FIG. 15
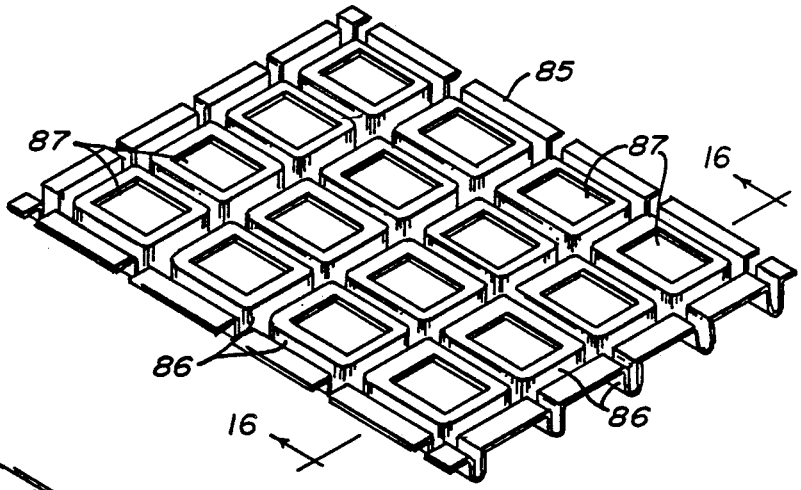
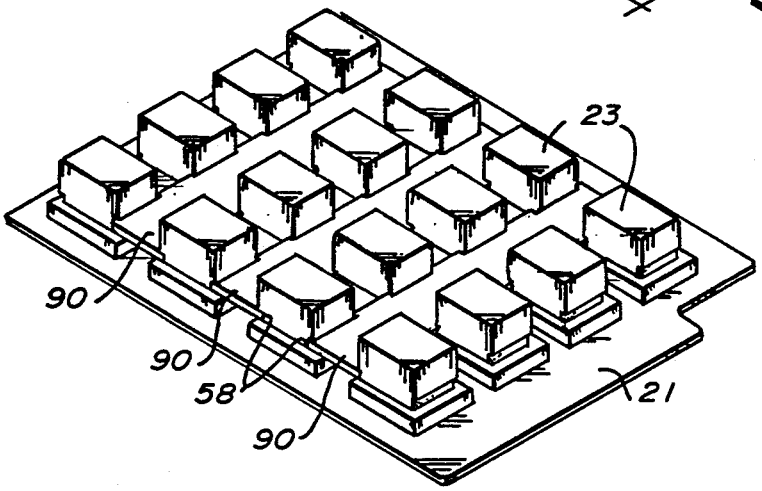
FIG. 17

STABILIZED MOLDED RUBBER KEYBOARDS

This invention relates to stabilized molded rubber keyboards.

BACKGROUND OF THE INVENTION

Molded rubber keyboards have been used in combination with underlying printed circuit boards to provide a keyboard structure much less expensive than those where each key requires a separate push button member separately mounted in a frame. The term "rubber", as used in this specification and in the claims, refers not only to synthetic and natural rubbers, but also to other elastomeric materials.

Molded rubber keyboards usually comprise a rubber sheet integral with upwardly projecting rubber keys. Each rubber key is located above a recess in the sheet and its lower end includes such means as conductive rubber members for closing the switch contacts on the PC board located directly below it. The recesses form a diaphragm which acts to space the conductive rubber members above the PC board, except when a particular key is pressed.

In spite of their advantages, these molded keyboards have also had some disadvantages. The principal disadvantage is that when a key is pressed down, it tends to wobble. Although the wobbliness may not actually affect the key's electrical function, it does affect its feel and the attitude of the user toward it. The user tends to view the whole instrument which incorporates the keyboard as lacking precision, and of being of low quality, simply because of the wobbling of the keys. Additionally, the wobbling effect does not inspire confidence that the switch contact has been made.

Attempts have been made to solve this problem. For example, guide pins were sometimes inserted in the center of each key and extended into corresponding holes in the printed circuit board. However, this approach added a number of parts—at least one pin in one hole for each key—and therefore considerably increased the overall cost. Moreover, the holes had to be drilled not only through each key but also through the PC board in a position through the center of its contacts, so that the drilling became a precision operation and was correspondingly expensive.

Another attempted solution was to mold the keys so that they were hinged on one side. However, such keys must then be activated in a rocking motion instead of straight line motion, and the response of many users was that they preferred even wobbly keys over this alternative.

Another proposed solution was to provide a molded or machined sleeve for each key and then insert the key buttons in the sleeves. The sleeves were to be of stiff plastic or metal. The sleeve was to provide a mechanical guide for the key button. However, when the key button was depressed, it tended to stick on the side of the sleeve, holding the switch open. Since they were not integral with the molded keyboard, many additional parts were required; so while there was a gain in the prevention of wobbling, the added expense was undesirable.

Another solution that was proposed was to provide a molded plastic key which would ride in a molded or mechanical sleeve and make contact with the rubber key when the key was depressed. Many additional parts were required; so while wobbliness was prevented, the added expense was undesirable.

An object of the present invention is to solve the problems of wobbliness and binding, while holding the number of extra parts down to a minimum.

SUMMARY OF THE INVENTION

As in current practice, the PC board that provides the series of switch contacts is overlaid with a molded rubber keyboard. This keyboard comprises a rubber base sheet that directly overlies the PC board and a series of rubber keys or key caps integral with that base sheet. Each key is provided with switch-contact members on their upwardly recessed bottom surfaces. These standard elements are, in this invention, combined with a stabilizing membrane which snugly engages each key. Though flexible itself along the Z axis, the stabilizing membrane is made sufficiently still along the X and Y axes to limit the movement of the keys to a substantially strictly linear movement toward and away from the PC board switch contacts.

Various forms of the invention are disclosed. In some preferred forms each key of the rubber keyboard is provided with a shoulder on which the membrane rests. The membrane insertion on top of the keyboard may be made easier by providing slits or cutouts at the corners or along the edges of the openings through the membrane.

In another form of the invention there is a groove in each key, and these grooves are engaged by the membrane.

The membrane may be formed with a series of bubble-like portions that actually touch the keyboard's base sheet, while also having portions that engage the shoulder or groove of the keys. There are other similar types of membranes with ridge-like formations.

Still another system clamps the membrane in place over the top of the keys, with the aid of additional key caps.

Yet another modification of the invention uses strips of membrane material instead of a single membrane. Even then, however, the membrane strips are few relative to the number of keys.

Other objects and advantages of the invention will appear from the following description and from the drawings.

BRIEF DESCRIPTION OF THE DRAWINGS

FIG. 5 is a bottom view of a portion of the rubber keyboard of FIG. 1, showing the recesses and contact members of the keys.

FIG. 6 is a fragmentary isometric view of part of a membrane showing several different forms of membrane opening relief means that may be used to assist installation.

FIG. 7 is a fragmentary isometric view of part of a modified form of membrane with elongated slots between key openings to facilitate installation of the membrane on the keyboard.

FIG. 8 is an isometric view of another modified form of membrane, this one having marginal reinforcements.

FIG. 9 is a fragmentary view in elevation and in section of part of a modified assembly of a rubber keyboard and membrane, wherein the keys have grooves instead of shoulders, the membrane fitting into the grooves.

FIG. 10 is an enlarged fragmentary isometric view of a modified form of membrane of the invention, in which the membrane is formed into a series of bubble-like portions.

FIG. 11 is a fragmentary enlarged view in side elevation of the installed membrane of FIG. 10, with the keys shown in broken lines ut the base sheet shown in solid lines.

FIG. 12 is a fragmentary enlarged view in elevation and in section of a portion of an assembly using the membrane of FIG. 13. One keycap is about to be installed, while others are already in place.

FIG. 13 is an isometric view of the membrane used in FIG. 12.

FIG. 14 is an isometric view of an assembly having another modified form of membrane, which has marginal supports therearound.

FIG. 15 is an isometric view of still another modified form of membrane having support legs that, in an assembly, lie between keys and support the membrane.

FIG. 17 is an isometric view of yet another assembly, this one employing a series of membrane strips instead of a single membrane.

DESCRIPTION OF SOME PREFERRED EMBODIMENTS

Figure 1:
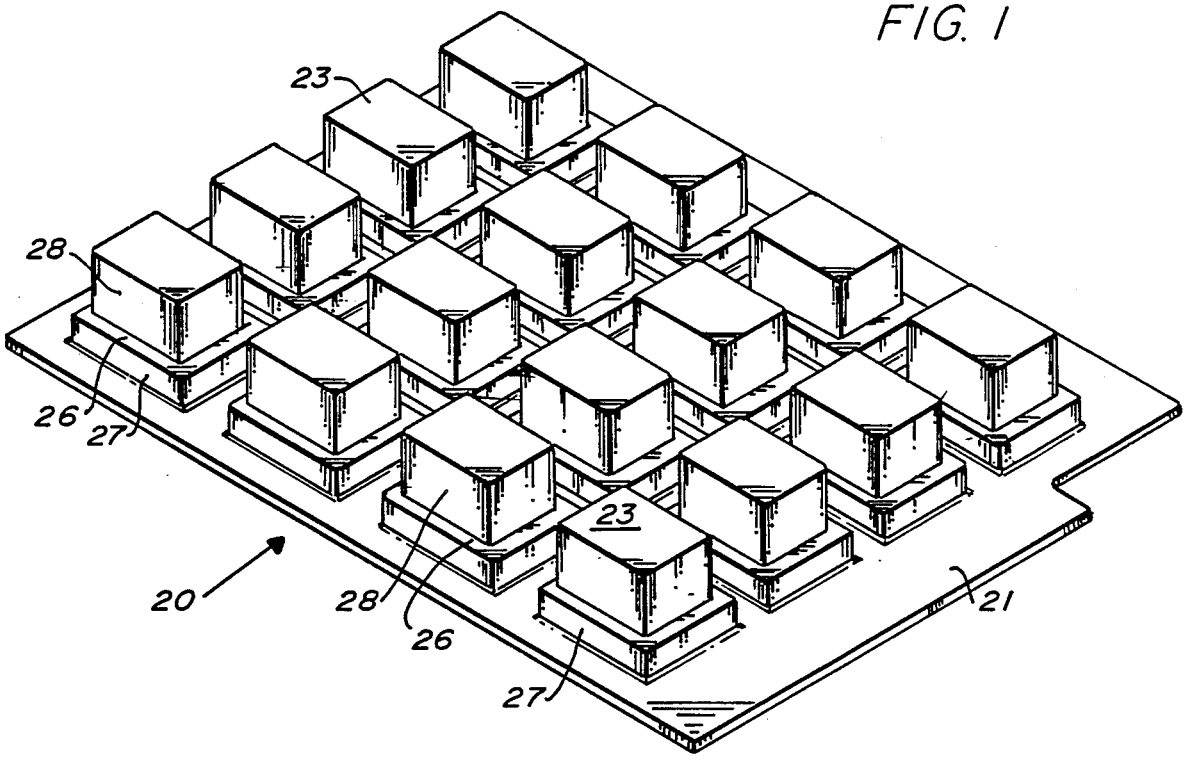
FIG. 1 is an enlarged isometric view of a rubber, one-piece, molded rubber keyboard of a type that may be used in this invention.

FIGS. 1–5 show a presently preferred embodiment of the invention. FIG. 1 shows a typical rubber keyboard 20 having a base sheet 21, with a series of recesses 22, leading up from the bottom surface, as seen in FIG. 5. Above each recess 22 and integral with the base sheet 21 is a key 23 having on its bottom surface 24 one or more conductive-rubber, switch-closing contact members 25. In the form of the invention shown in FIGS. 1–5, each key 23 has a shoulder 26 joining a lower key portion 27 of larger cross-section to an upper portion 28 of smaller cross-section.

Figure 4:
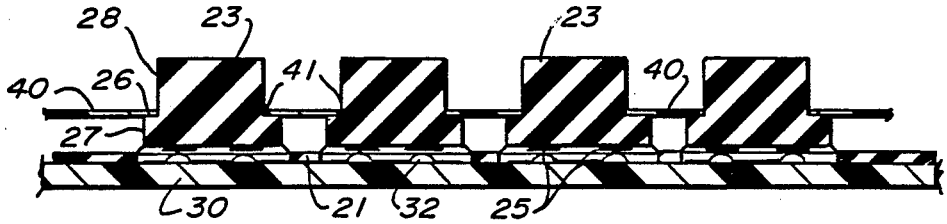
FIG. 4 is a view in section taken along the line 4—4 in FIG. 2.
Figure 2:
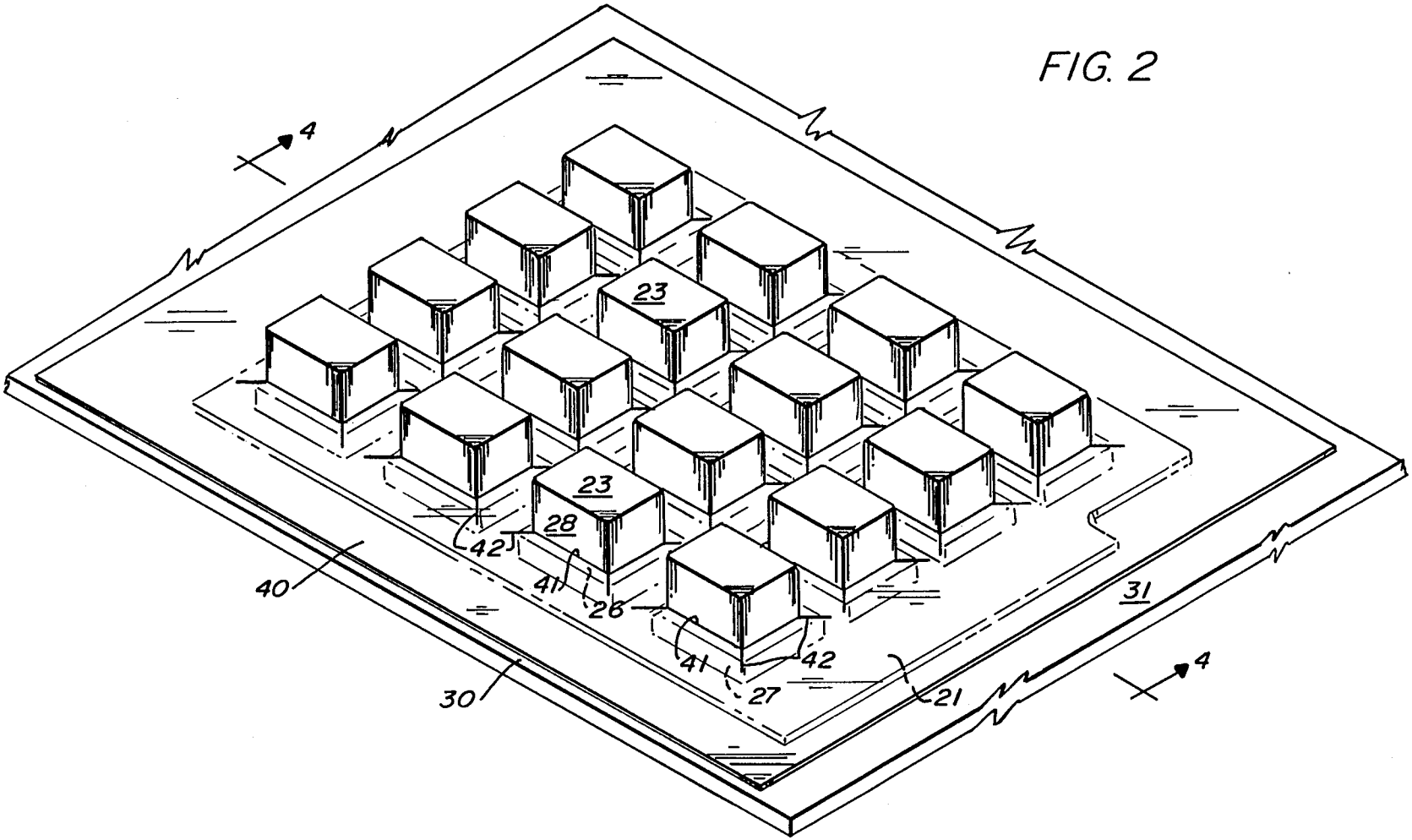
FIG. 2 is an enlarged isometric view of an assembly according to the principles of this invention, in which the molded rubber keyboard overlies a printed circuit board and is provided with a membrane supported on the shoulders of the keys.
Figure 3:
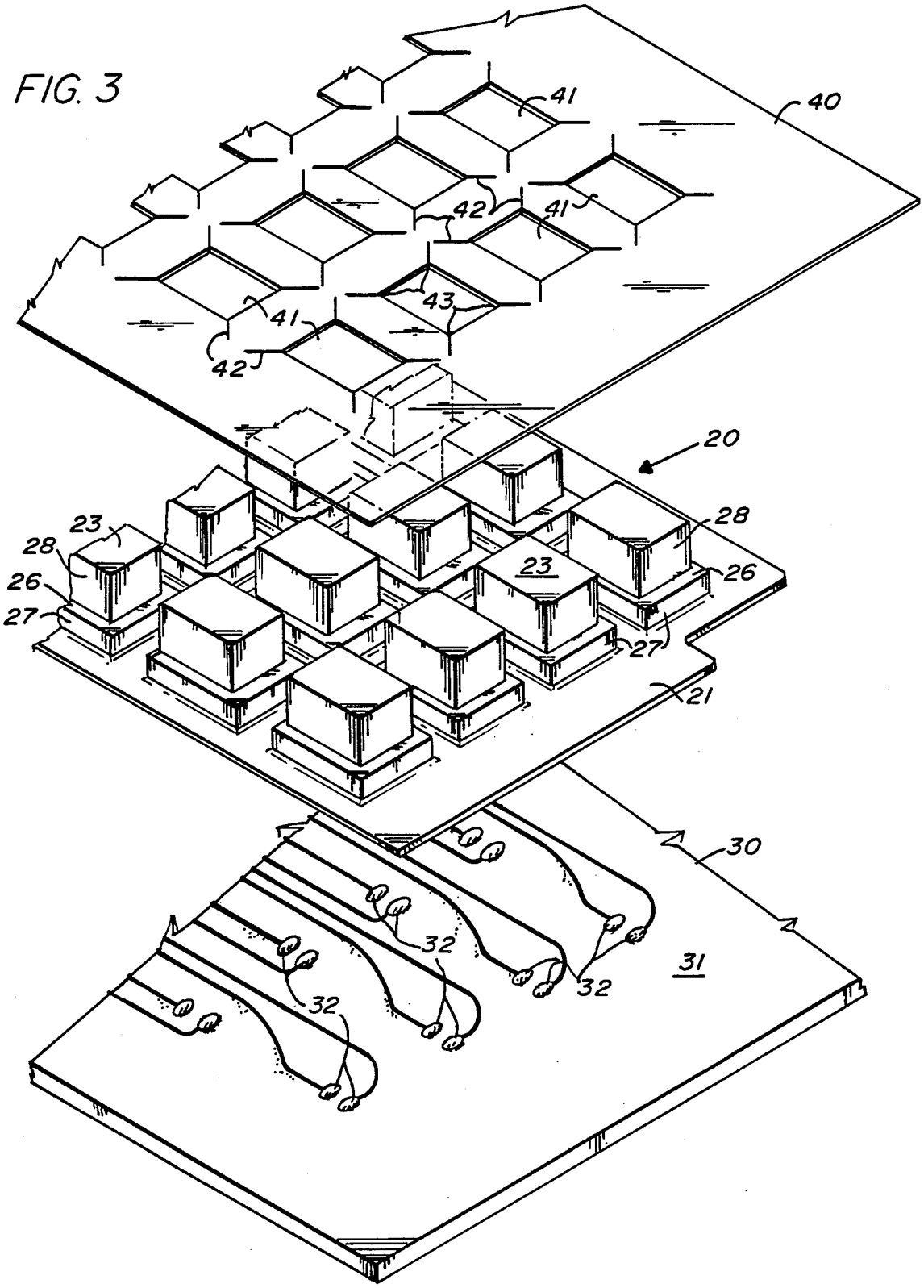
FIG. 3 is an exploded isometric view of the assembly of FIG. 2, with portions broken off therefrom.

The base sheet 21 overlies a printed circuit (PC) board 30, shown in FIGS. 2–4. The base sheet 21 may rest on and be secured to portions of the upper surface 31 of the board 30. The PC board 30 is provided with printed circuitry including a series of normally open switch contacts 32, usually in groups, such as pairs, one pair (or group) per key. The keyboard 20 and PC board 30 are made so that each switch 32 is correctly aligned with a recess 22 and the contacts 25. Thus, when a key 23 is depressed, it bridges a pair (or group) of switch contacts 32 of the PC board 30.

The keys 23, being molded from rubber and being integral with the rubber sheet 21, tend to wobble when they are actuated. This is the problem which the invention addresses.

The present invention solves this problem by incorporating into the assembly a membrane 40, which may be of Mylar or similar material. The membrane 40 is thin enough to be flexible along the Z axis, but is made of relatively stiff material and is stiff along the X and Y axes. It is provided with a series of openings 41 which are made as close as possible to the size of the upper portion 28 of the keys 23. The membrane 40 is placed over the keys 23 and pressed down until the membrane 40 rests on the shoulders 26 of the keys 23, as shown in FIG. 2. Once in that position, the membrane 40 is braced by all of the keys 23; so that when one key 23 is depressed, that key 23 moves down in a straight line, being held from wobbling by the membrane 40, which itself is supported by the other keys 23.

Various forms of the membrane 40 may be employed. In the form shown in FIGS. 1–5, the membrane 40 is provided with a short slit or cut 42 leading out diagonally from each corner 43 of the opening 41. The slit 42 does not reach or intersect any other slit, but it provides enough freedom so that application of the membrane 40 to the keyboard 20 becomes quite simple.

FIG. 6 shows a membrane 40 provided with six different expedients for aiding the installation of the membrane. The corner slits 42 of FIGS. 1–5 are shown at one opening 41. At another opening 41 there are V cuts 44 extending out from each of the edges of the opening 41. Another opening 41 has a half-circle cut 45 along each edge; another opening 41 has slits 46 extending from the middle of each edge; another has square cuts 47 extending from the middle of each edge. Finally, one window or opening 41 is shown having no cuts. Those with cuts or slits are easier to install, and they help to reduce movement of other keys while one is being depressed, but it is not necessary to have them.

FIG. 7 shows a form of membrane 50 of the invention, having openings or windows 51, one for each key. Here, there are cutout slots 52 in between successive rows of windows 51. These slots 52 increase the X-Y axis flexibility of the membrane 50 at the slots enough to help to prevent keys, other than the one being depressed, from moving.

FIG. 8 shows a self-supporting membrane 55 with a marginal reinforcing or thickening portion 56 secured therearound and helping to stiffen the membrane 55 in general, while the membrane 55 retains elsewhere its flexibility, especially adjacent its openings 57.

FIG. 9 illustrates another form of the invention in which each key 23 has grooves 58 around its periphery, instead of a shoulder. A membrane 40 may then be snapped into the grooves 58. The membrane used may be any of those so far discussed.

FIGS. 10 and 11 show another form of the invention. A self-supporting membrane 60 is formed with bubbles 61 in between its windows 62. These bubbles 61 are formed so that they all lie along a plane, so that upon installation of the membrane 60 that plane engages the top surface of the base sheet 21. The bubbles 61 thus provide for support for the membrane 60 by the base sheet 21. The membrane 60 may be installed on a shoulder 26 as shown, or in grooves as in FIG. 9.

FIGS. 12 and 13 show another modified form of the invention, in which some extra members are required. In this invention, a membrane 70 is provided with a series of round holes 71, and a keyboard 72 is made with short rubber keys 73 having round holes 74 leading in from their upper surfaces 75 to an enlarged inner portion. Then each key 73 is supplemented by a plastic key cap 76 which fits over the main key 73 and has a base nipple 77 extending through that opening 71 and into the opening 74 in the key 73, clamping the membrane 70 between the keys 73 and the plastic caps 76. This need not be expensive, and installation is relatively simple, as compared with drilling or the use of separate metal members. The keys 73 and caps 76 may be formed in any way which provides a suitable lock, the illustration being only by way of example.

Still another form of self-supporting membrane 80 is shown in FIG. 14. The membrane 80 is formed with a depending portion 81 at its margin, lying at 90° to a main portion 82 having the windows 83. The lower edges 85 contact the upper surface of the sheet 21 of the keyboard 20, and thereby support the membrane 80.

Figure 16:
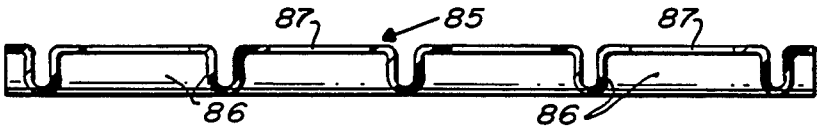
FIG. 16 is a view in elevation and in section taken along the line 16—16 in FIG. 15.

A similar type of membrane 85, shown in FIGS. 15 and 16, provides legs 86, not only around the group of keys 23, but also between each key 23 and its adjacent keys 23. That leaves a series of short legs 86 adjacent each side of the membrane's windows 87, except on the outer marginal area where the legs can be continuous. These outer legs 86 may rest on the PC board 30 and they aid in stabilization.

Still another form of the invention is shown in FIG. 17 in which the stabilizing is achieved by a series of separate membrane strips 90, rather than by a single sheet. The strips 90 are installed between adjacent rows and engage grooves (as shown) or shoulders, if desired. There may be another series of strips extending perpendicularly to these strips 90, if desired. Generally, however, it is believed that a single row of strips is satisfactory.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. In a keyboard assembly having a PC board providing a series of switches and a molded rubber keyboard providing a rubber base sheet overlying said PC board and having a series of rubber keys integral with said base sheet, each said key having contact means on its bottom surface for closing each said switch when its key is depressed, said keyboard having sufficient inherent elasticity to restore any depressed key back to its original position when the key is released, the combination therewith of stabilizing membrane means for preventing said keys from wobbling or binding, said membrane means having a first surface disposed on an opposite side of said rubber base sheet from said PC board and a second surface separated from said first surface by the height of said membrane means, said keys extending through said membrane means such that each said key extends from beneath said first surface to above said second surface so that each said key can be depressed by direct contact by a finger of a user, said membrane means being substantially continuous around the periphery of each said key for snugly engaging each said key around substantially its entire periphery, said membrane means being flexible along its Z axis, but sufficiently still along its X and Y axes, to remain in contact with substantially the entire periphery of each said key and to limit the movement of said keys to a strictly linear movement toward and away from their respective PC board switches, the flexibility of said membrane means along its Z axis enabling said membrane means to follow each said key up and down without binding it.

2. The assembly of claim 1 wherein said keys have vertical side walls and said membrane means is a single sheet having a series of key-size openings for snugly engaging all said side walls of said keys.

3. The assembly of claim 2 wherein said sheet has a thickened portion around its edges to stiffen it.

4. The assembly of claim 1, wherein said membrane means is a single sheet having a series of small openings therethrough, said sheet resting on top of said keys, and a series of key caps having connection means for securing said key caps to said keys, said connection means extending through said small openings and clamping said sheet between said key caps and said keys.

5. The assembly of claim 1 wherein said membrane means comprises a series of strips extending in a row between said keys and snugly engaging them.

6. A keyboard assembly comprising a printed-circuit board having a series of groups of open switch contacts arranged in a pattern, a molded rubber keyboard having a base sheet overlying said board and a series of integral depressible keys, each having at its bottom end a recessed portion overlying a said group of switch contacts, said recessed portion having contact means on the bottom of each said key for closing said switch contacts, said keys each having an upwardly projecting body with side walls, said keyboard having inherent elasticity for restoring any depressed key back to its original position when the key is released, and a membrane having through openings corresponding in size, shape, and position closely to the size, shape, and position of said key side walls, said membrane having a first surface disposed on an opposite side of said rubber base sheet from said board and a second surface separated from said first surface by the height of said membrane, said keys extending through said membrane such that each said key extends from beneath said first surface to above said second surface so that each said key can be depressed by direct contact by a finger of a user, said membrane being flexible along its Z axis but still along its X and Y axes, said membrane being substantially continuous around the periphery of each said key for engaging said side walls around substantially the entire periphery of each said key and thereby restraining each said key along its X and Y axes to follow a vertical path during both depression and release, the flexibility of membrane along its Z axis enabling said membrane to follow said keys up and down rather than binding them.

7. The assembly of claim 6 wherein each key has a shoulder, all said shoulders being coplanar, said membrane resting on said shoulders.

8. The assembly of claim 6 wherein said keys have horizontal grooves, all coplanar, said membrane engaging in said grooves.

9. A keyboard assembly comprising a printed-circuit board having a series of groups of open switch contacts arranged in a pattern, a molded rubber keyboard having a base sheet overlying said board and a series of integral, depressible keys, each having at its bottom end a recessed portion overlying a said group of switch contacts, said recessed portion having contact means on the bottom of each said key for closing said switch contacts, said keys each having an upwardly projecting body with vertical side walls and with an exterior shoulder around each said key, spaced up from said base sheet and down from the top of each said key and providing a narrower key portion above said shoulder and a wider portion below it, all said shoulders being at the same level, said keyboard having inherent elasticity for restoring any depressed key back to its original position when the key is released, and a membrane that is flexible along the Z axis and rigid along the X and Y axes having through openings corresponding in size, shape, and position closely to the size, shape, and position of said key upper portions, said membrane having a first surface disposed on an opposite side of said rubber base sheet from said board and a second surface separated from said first surface by the height of said membrane, said keys extending through said membrane such that each said key extends from beneath said first surface to above said second surface so that each said key can be depressed by direct contact by a finger of a user, said membrane being substantially continuous around the periphery of each said key for snugly engaging all said vertical side walls around substantially the entire periphery of each said key and resting on said shoulders and restraining each said key to follow a vertical path during both depression and release, the flexibility of said membrane along its Z axis enabling said membrane to follow said keys up and down rather than binding them.

10. The assembly of claim 9 wherein each membrane's through opening is rectangular with edges and corners, and relief means extending out from each opening to provide additional flexibility for installation.

11. The assembly of claim 10 wherein said relief means comprises diagonal slits extending out into said membrane from each said corner.

12. The assembly of claim 10 wherein said relief means comprises slits extending out into said membrane from said edges.

13. The assembly of claim 10 wherein said relief means comprises a series of cut-out portions adjoining said edges.

14. The assembly of claim 10 wherein said relief means comprises a series of long through slots in between adjacent rows of said openings.

15. The assembly of claim 9 wherein said membrane is provided with portions engaging said base sheet.

16. The assembly of claim 15 wherein said portions engaging said base sheet are located only around the margins of said membrane.

17. The assembly of claim 15 wherein said portion engaging said base sheet surrounds each said key.

18. A keyboard assembly comprising a printed-circuit board having a series of pairs of open switch contacts arranged in a pattern, a molded rubber keyboard having a base sheet overlying said board and a series of integral depressible keys, each having at its bottom end a recessed portion overlying a said pair of switch contacts, said recessed portion having contact means on the bottom of each said key for closing said switch contacts, said keys each having an upwardly projecting body with a horizontal groove therearound, spaced up from said sheet and down from the top of each said key, all said grooves being coplanar, said keyboard having elasticity for restoring any depressed key to its original position when the key is released, and a flexible but self-supporting membrane having through openings corresponding in shape and location to the shape and location of said keys, said membrane having a first surface disposed on an opposite side of said rubber base sheet from said boad and a second surface separated from said first surface by the height of said membrane, said keys extending through said membrane such that each said key extends from beneath said first surface to above said second surface so that each said key can be depressed by direct contact by a finger of a user, said membrane being substantially continuous around the periphery of each said key for engaging in said grooves around substantially the entire periphery of each said key and restraining each said key to follow a vertical path during both depression and release, said membrane being rigid along its X axis and its Y axis but flexible along its Z axis.

* * * * *